US005397295A

United States Patent [19]

van Deursen

[11] Patent Number: 5,397,295

[45] Date of Patent: Mar. 14, 1995

[54] CHAIR

[76] Inventor: Leonardus L. J. M. van Deursen, Schepenenstraat 65, 5663 GH Geldrop, Netherlands

[21] Appl. No.: 72,607

[22] Filed: Jun. 4, 1993

[30] Foreign Application Priority Data

Jun. 10, 1992 [NL] Netherlands ..... 9201021

[51] Int. Cl.[6] ..... A61H 7/00

[52] U.S. Cl. ..... 601/91; 601/98; 297/337

[58] Field of Search ..... 297/337; 601/91, 89, 601/90, 86, 98

[56] References Cited

U.S. PATENT DOCUMENTS

| | | | |
|---|---|---|---|
| 2,644,958 | 7/1953 | Davis | 601/90 |
| 2,908,271 | 10/1959 | Ware | 601/98 |
| 2,916,745 | 12/1959 | Lesk et al. | 601/98 |
| 3,104,139 | 9/1963 | Thompson | 297/337 |
| 4,860,733 | 8/1989 | Parker, Jr. | 601/91 |

FOREIGN PATENT DOCUMENTS

| | | | |
|---|---|---|---|
| 56274 | 10/1890 | Germany . | |
| 119622 | 10/1900 | Germany | 297/337 |
| 287619 | 1/1914 | Germany . | |
| 8914349 | 1/1990 | Germany . | |
| 1370 | 2/1914 | United Kingdom | 601/91 |
| 2133995 | 8/1984 | United Kingdom . | |

*Primary Examiner*—John T. Kwon
*Attorney, Agent, or Firm*—Ladas & Parry

[57] ABSTRACT

A chair provided with at least one leg supporting the chair on the ground, with a back supported by the leg(s) and with a seat supported by the leg(s), whereby the seat is pivotable with respect to the back about an at least substantially vertical axis, wherein by means of a driving member the said seat is pivotable to the left and to the right through maximally 10° from a central position.

4 Claims, 1 Drawing Sheet

CHAIR

The invention relates to a chair provided with at least one leg supporting the chair on the ground, with a back supported by said leg(s) and with a seat supported by said leg(s), whereby said seat is pivotable with respect to said back about an at least substantially vertical axis.

Such a chair is known e.g. from DE-A-56274. In said chair the seat is freely rotatable over an unlimited angle for permitting the user of the chair an easy turning when sitting on the chair.

Now epidemiologicial studies show that there is a relationship between sitting and back pain.

Low back pain (L.B.P.) is a common ailment, affecting 70%–80% of the population in industrialized countries.

At the moment two school s of thought have developed concerning the influence of sitting posture on low back structures.

Some researchers support the idea that flexed postures, which reduce or eliminate the normal lumbar lordosis, will decrease stress on the posterior portions of the vertebrae and discs. These flexed positions may improve disc nutrition, slow the degenerative process and consequently result in a reduction of L.B.P. Population studies have shown that lumbar disc degeneration is rare among people who habitually sit or squat in postures which flatten the lumbar spine.

Others claim that maintenance of lumbar lordosis during sitting decreases both intradiscal pressure and myoelectric activity of the posterior parapspinal muscles. They intend to say that the best sitting posture will be the posture with the lowest disc pressure and the lowest muscle activity in the back muscles.

As you see, all attention concerning the influence of sitting and its relationship to. L.B.P. is based on the position of the low back in relation to the chair. But in the many studies concerning this object and in the discussion of what would be the best, there is little attention for the patients complains and a lot of attention for muscle activities and disc pressure.

From an analysis of the patients complaints, it is obvious that sitting in general is most provocative and is giving rise to very much complaints. Prolonged sitting is medically accepted as a high risk factor in L.B.P.

In our study on L.B.P. patients 61% did prefer a straight chair with lumbar support to maintain lumbar lordosis. On the contrary 26% preferred lumbar kyphosis, while 23% did not have any prevalence. But even with the best personal support almost all patients still did get complaints in prolonged sitting, much more than in walking or moving around.

It seems to be obvious that prolonged sitting should be avoided, as said by many investigators.

Movements are taking care for better nutrition of the disc. Monotone positions are responsible for degenertion of low back structures. The process of nutrition of the nucleus pulposus has to be helped by rhythmical compression of the daily activities of the body. Active movements are helping in this process.

In view of the above it is assumed that the static factor of prolonged sitting is harmful.

Now according to the invention the chair of the kind set forth is characterised in that by means of driving means said seat is pivotable to the left and to the right through maximally 10° from a central position.

Characteristic of this chair is that there can be obtained a continuous mechanical rotatory movement between the seat of the chair and the backrest. While the seat is moving, the backrest is fixed. The seat is making a left to right rotational movement.

It has been shown that complaints about back pain diminish in using such a chair. It is assumed that movements are taking care for a better nutrition of the discs. By active movements the normal imbibition process between spongiosa and nucleus pulposus will be sustained and inevitable drying out of the discs in the elderly could be delayed.

It has been proven that rotatory movements of the low back are safe and hardly restricted, even in cases of discopathie or degeneration, while forward, backward and even lateral bending are restricted and harmful.

So if we want to give a dynamic impuls in sitting, this has to be a strictly rotatorial one, without any other component.

It is noted that from GB-A-2133995 there is known a back exercising apparatus having a seat performing during use a rotary tilting motion which tends to overbalance the patient. Said apparatus can not be used as a normal chair and there is a risk that the patient overburden its muscles and discs in trying to maintain an upright posture. On this apparatus patients have to make much more movements than the only allowed rotatorial one.

The invention will be explained in more detail hereafter with reference to a possible embodiment of the construction according to the invention diagrammatically illustrated in the accompanying figures.

Figure 1:
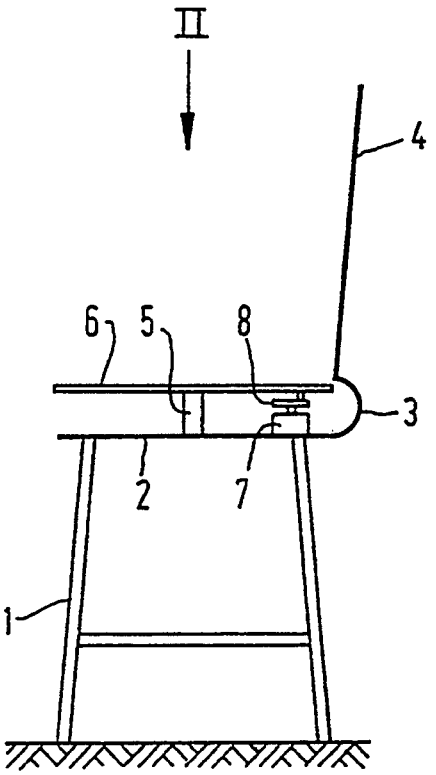
FIG. 1 is a diagrammatic side elevation of an embodiment of a chair according to the invention.

The chair shown in FIG. 1 comprises four legs 1, to which a supporting plate 2 is secured. A back 4 is secured to said supporting plate 2 by means of one or several more or less U-shaped connecting members 3.

A seat 6 is furthermore mounted on the supporting plate 2 by means of a vertical shaft 5, in such a manner that the rear edge of the seat 6 extends under the bottom end of the back 4 into the arcuate part(s) 3.

An electromotor 7 is furthermore mounted on the supporting plate 2. A disc 8 is secured to the outgoing shaft on the electromotor 7. One end of a connecting rod 9 is pivotally coupled to the disc 8 in a point which is spaced by some distance from the outgoing shaft of the motor 7.

The other end of the connecting rod 9 is pivotally coupled to the seat 6 in a point which is spaced from the shaft by some distance.

It will be apparent that when the motor 7 is rotated via the disc 8 and the connecting rod 9, together forming some kind of crank-connecting rod mechanism, the seat will be pivoted to and fro about the vertical shaft 5 with respect to the other parts of the chair.

Figure 2:
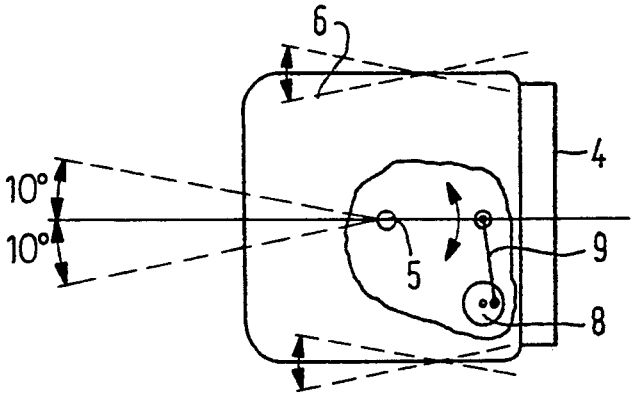
FIG. 2 is a diagrammatic plan view of the seat of the chair shown in FIG. 1, illustrating the driving mechanism.

The angle at which the seat 6 can be pivotally rotated to the left and to the right, about the vertical shaft 5, from a centered position, as shown in FIG. 2, will be 10° at most. In practice an angle of 1°–3° will generally be preferred.

Preferably the magnitude of the angle is adjustable, which may for example be effected by making the point of attachment of the connecting rod 9 to the seat 6 and/or the point of attachment of the connecting rod 9 to the disc 8 adjustable.

When using the chair the motor 7 may be allowed to run continuously, but also intermittent operation of the motor 7, by means of a suitable switching mechanism, is possible.

Of course also other driving means besides an electromotor are conceivable, such as for example a double-acting setting cylinder.

By accommodating the rear edge of the seat 6 in (an) arcuate part(s) 3 it can be prevented that objects become wedged between the rear edge of the reciprocating seat and the stationary back.

For ease of description the invention has been explained with reference to a chair supported by one or more legs. It will be apparent, however, that the definition used in the present description and claims is to be given a broad interpretation, and that it is also meant to include chairs which are supported by frame parts other than the customary legs, such as for example those used for car seats or wheelchairs.

We claim:

1. A chair comprising:

at least one leg for supporting the chair;

a back supported by the legs;

a seat supported by the legs; and driving means for pivotally rotating the seat relative to the back, whereby the seat is pivotal with respect to the back about a substantially vertical axis, and the driving means pivotally rotates the seat relative to the back from a centered position relative to the back in an oscillatory side-to-side movement, the angle of movement from the centered position to any one side not exceeding an angle of 10°.

2. A seat as claimed in claim 1 wherein the seat moves to a maximum angle of 1° to 3° to each side from the centered position.

3. A seat as claimed in claim 1 wherein the magnitude of the angle through which the seat can be pivotally rotated from the centered position is adjustable.

4. A seat as claimed in claim 1 wherein the driving means is operable intermittently.

* * * * *